US009144281B2

(12) United States Patent
Cross

(10) Patent No.: US 9,144,281 B2
(45) Date of Patent: Sep. 29, 2015

(54) BAG WITH BUILT-IN RECEPTACLE DEVICE

(71) Applicant: GOPLUG BAGS, INC., Sandy, UT (US)

(72) Inventor: Joshua Seth Mark Cross, Magna, UT (US)

(73) Assignee: GOPLUG BAGS, INC., Sandy, UT (US)

( * ) Notice: Subject to any disclaimer, the term of this patent is extended or adjusted under 35 U.S.C. 154(b) by 0 days.

(21) Appl. No.: 14/509,944

(22) Filed: Oct. 8, 2014

(65) Prior Publication Data

US 2015/0101958 A1 Apr. 16, 2015

Related U.S. Application Data

(60) Provisional application No. 62/060,889, filed on Oct. 7, 2014, provisional application No. 61/889,404, filed on Oct. 10, 2013.

(51) Int. Cl.

| | |
|---|---|
| ***H01M 10/44*** | (2006.01) |
| ***H01M 10/46*** | (2006.01) |
| ***A45C 13/02*** | (2006.01) |
| ***A45C 15/00*** | (2006.01) |
| ***A45C 5/14*** | (2006.01) |
| ***A45C 11/38*** | (2006.01) |
| ***A45F 3/02*** | (2006.01) |
| *A45C 11/00* | (2006.01) |

(52) U.S. Cl.

CPC . *A45C 13/02* (2013.01); *A45C 5/14* (2013.01); *A45C 11/38* (2013.01); *A45C 15/00* (2013.01); *A45F 3/02* (2013.01); *A45C 2011/001* (2013.01); *A45C 2011/002* (2013.01); *A45C 2011/003* (2013.01); *A45C 2013/025* (2013.01); *A45C 2200/00* (2013.01); *A45F 2200/0508* (2013.01); *A45F 2200/0516* (2013.01); *A45F 2200/0525* (2013.01); *A45F 2200/0533* (2013.01)

(58) Field of Classification Search

CPC ..... H02J 7/0027
USPC ..... 320/107
See application file for complete search history.

(56) References Cited

U.S. PATENT DOCUMENTS

| | | | | |
|---|---|---|---|---|
| 7,619,884 | B1 * | 11/2009 | Gray | 361/679.41 |
| 2005/0016579 | A1 * | 1/2005 | Elazari | 136/244 |
| 2005/0161079 | A1 * | 7/2005 | Gray | 136/291 |
| 2010/0231161 | A1 * | 9/2010 | Brown | 320/101 |
| 2011/0011761 | A1 | 1/2011 | Enmon | |
| 2012/0262117 | A1 * | 10/2012 | Ferber et al. | 320/111 |

OTHER PUBLICATIONS

International Search Report and Written Opinion mailed Jan. 21, 2015 in related PCT Application No. PCT/US2014/059924 (14 pgs.).

(Continued)

*Primary Examiner* — Edward Tso
*Assistant Examiner* — Ahmed Omar
(74) *Attorney, Agent, or Firm* — Maschoff Brennan

(57) ABSTRACT

Receptacle device built into a bag. In one example embodiment, a receptacle device is configured to be built into a bag. The receptacle device includes a frame and a first set of electrical receptacles rotatably attached to the frame. The frame defines an interior side and an exterior side. The first set of electrical receptacles is configured to be rotated with respect to the frame between being exposed on the exterior side and being exposed on the interior side.

20 Claims, 9 Drawing Sheets

(56) References Cited

OTHER PUBLICATIONS

"ChargerGenie", online startup campaign, INDIEGOGO, accessed on Oct. 8, 2014 at https://www.indiegogo.com/projects/chargergenie.

Laura Bly, "Backpack Promises to Charge Batteries on the Go", online article, Sep. 27, 2010, accessed on Oct. 8, 2014 at http://travel.usatoday.com/destinations/dispatches/post/2010/09/backpack-keeps-batteries-charged-while-youre-on-the-go-1-2/125299/1.

U.S. Appl. No. 61/889,404, filed Oct. 10, 2013, titled Bags With Built-In Electrical Receptacles.

b. U.S. Appl. No. 62/060,889, filed Oct. 7, 2014, titled Bags With Built-In Electrical Receptacles.

* cited by examiner

BAG WITH BUILT-IN RECEPTACLE DEVICE

CROSS-REFERENCE TO RELATED APPLICATIONS

This application claims the benefit of and priority to U.S. Provisional Application No. 61/889,404, filed Oct. 10, 2013, titled "BAGS WITH BUILT-IN ELECTRICAL RECEPTACLES," which is incorporated herein by reference in its entirety. This application also claims the benefit of and priority to U.S. Provisional Application No. 62/060,889, filed Oct. 7, 2014, titled "BAGS WITH BUILT-IN ELECTRICAL RECEPTACLES," which is incorporated herein by reference in its entirety.

FIELD

The embodiments disclosed herein relate to a receptacle device that is configured to be built into a bag.

BACKGROUND

Portable electronic devices are increasing in popularity. Examples of portable electronic devices include laptops, tablet computers, cellular smartphones, cellular "dumb" phones, music players, video players, cameras, video recorders, etc. While varying in their functionality and features, one thing that most portable electronic devices have in common is one or more internal rechargeable batteries, which require the electronic device to be regularly recharged by being plugged into a power outlet.

Unfortunately, aging infrastructure in public spaces such as airports, bus terminals, rest stops, museums, and parks were not originally designed to accommodate the dramatic increase in the need for power outlets that has resulted from the increasing popularity of portable electronic devices. Therefore, there generally are not enough power outlets, or the right type of power outlets, to meet the demand for power outlets in most of these public spaces.

Accordingly, there is a need in the art for more power outlets, and more of the right type of power outlets, to satisfy the recharging need of increasingly popular portable electronic devices.

The subject matter claimed herein is not limited to embodiments that solve any disadvantages or that operate only in environments such as those described above. Rather, this background is only provided to illustrate one example technology area where some embodiments described herein may be practiced.

SUMMARY

In general, example embodiments described herein relate to a receptacle device that is configured to be built into a bag. Multiple portable electronic devices may simultaneously be plugged into receptacles of the example receptacle devices disclosed herein, when built into bags as disclosed herein, in order to recharge the portable electronic devices, even in public spaces such as airports, bus terminals, rest stops, museums, and parks where few power outlets are available. Further, the built-in receptacle devices disclosed herein may be rotatable such that multiple portable electronic devices may be simultaneously recharged, regardless of whether the portable electronic devices are positioned on the exterior of the bag or in the interior of the bag.

In one example embodiment, a receptacle device includes a frame and a first set of electrical receptacles rotatably attached to the frame. The frame is configured to be built into a bag and defines an interior side and an exterior side. The first set of electrical receptacles is configured to be rotated with respect to the frame between being exposed on the exterior side and being exposed on the interior side.

In another example embodiment, a bag includes an interior compartment, a compartment wall, and a first set of electrical receptacles. The compartment wall at least partially defines the interior compartment and separates the interior compartment from an exterior of the bag. The first set of electrical receptacles is built into the compartment wall and is configured to be rotatable in the compartment wall between being exposed to an exterior of the bag and being exposed to the interior compartment.

In yet another example embodiment, a bag includes an interior compartment, an exterior receptacle compartment, a compartment wall, a set of electrical receptacles, and an openable receptacle compartment cover. The compartment wall at least partially defines the interior compartment and the exterior receptacle compartment and separates the interior compartment from the exterior receptacle compartment. The set of electrical receptacles is built into the compartment wall and is exposed to the exterior receptacle compartment. The openable receptacle compartment cover also at least partially defines the exterior receptacle compartment and is configured to be opened in order to expose the set of electrical receptacles to an exterior of the bag.

It is to be understood that both the foregoing general description and the following detailed description are exemplary and explanatory and are not restrictive of the invention, as claimed.

BRIEF DESCRIPTION OF THE DRAWINGS

Example embodiments will be described and explained with additional specificity and detail through the use of the accompanying drawings in which.

DESCRIPTION OF EMBODIMENTS

Figure 1A:
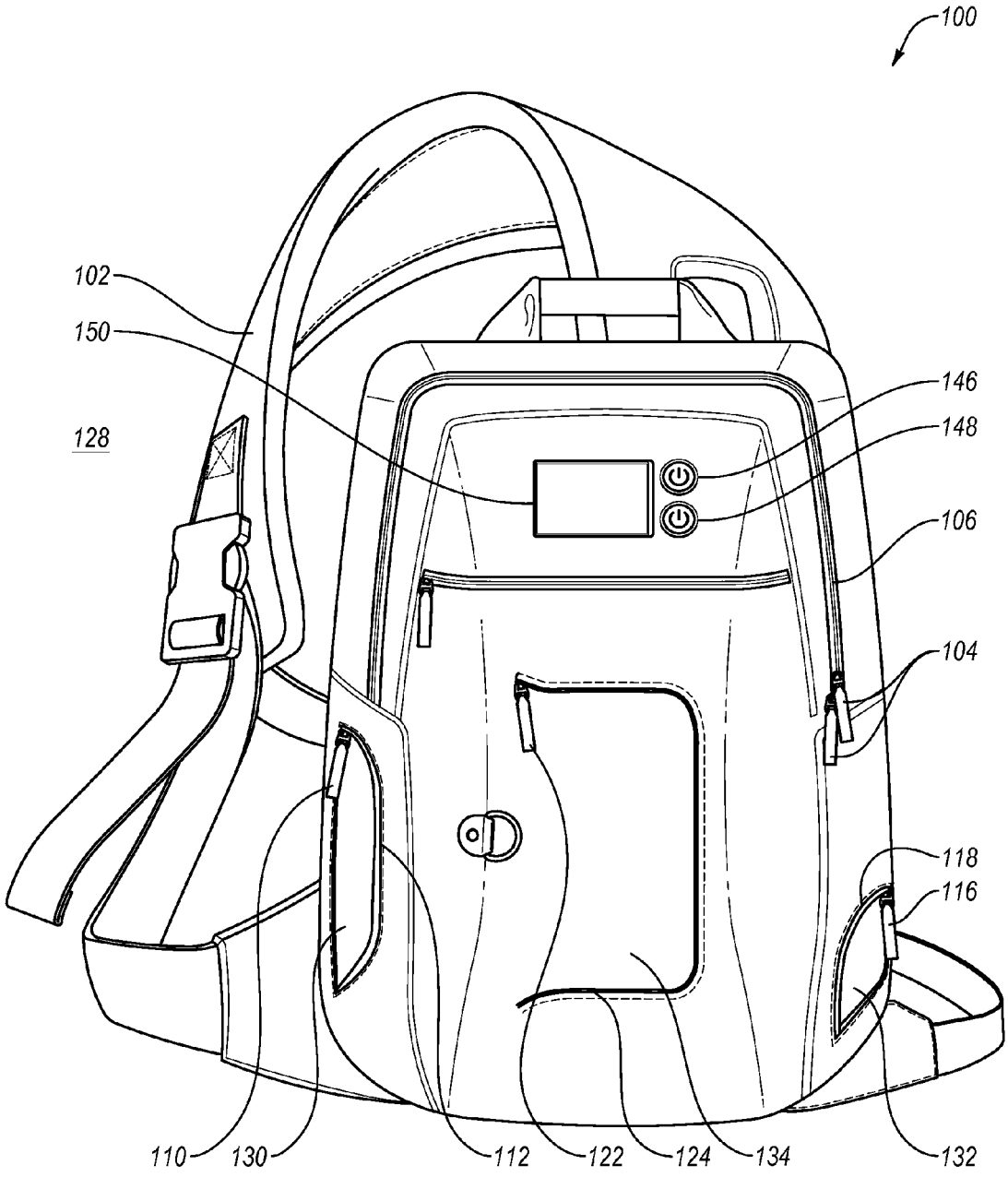
FIG. 1A is a front view of an example sling bag.
Figure 1B:
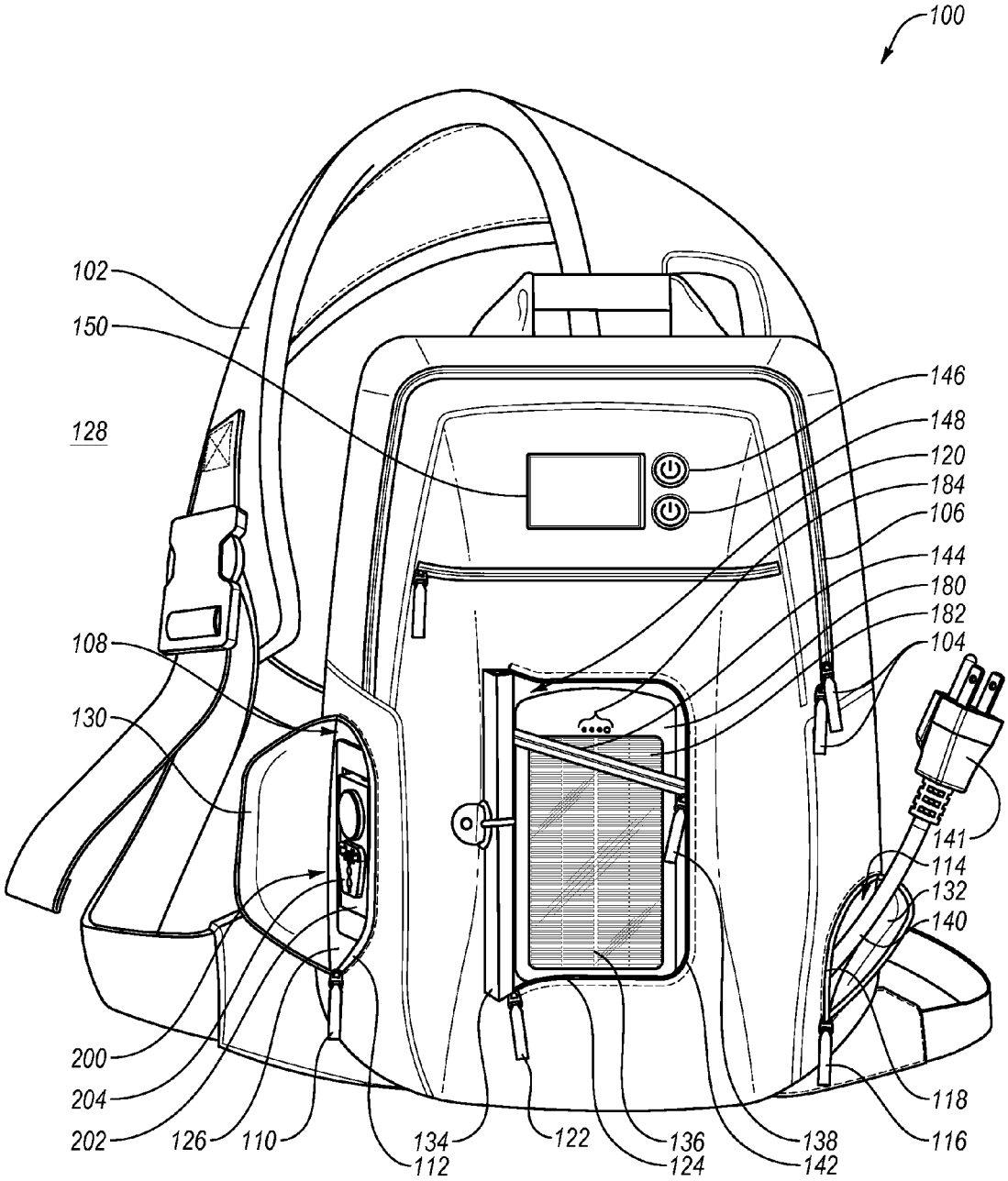
FIG. 1B is a front view of the example sling bag of FIG. 1A with a built-in rotatable receptacle device, a built-in power cord, and a battery exposed.
Figure 1C:
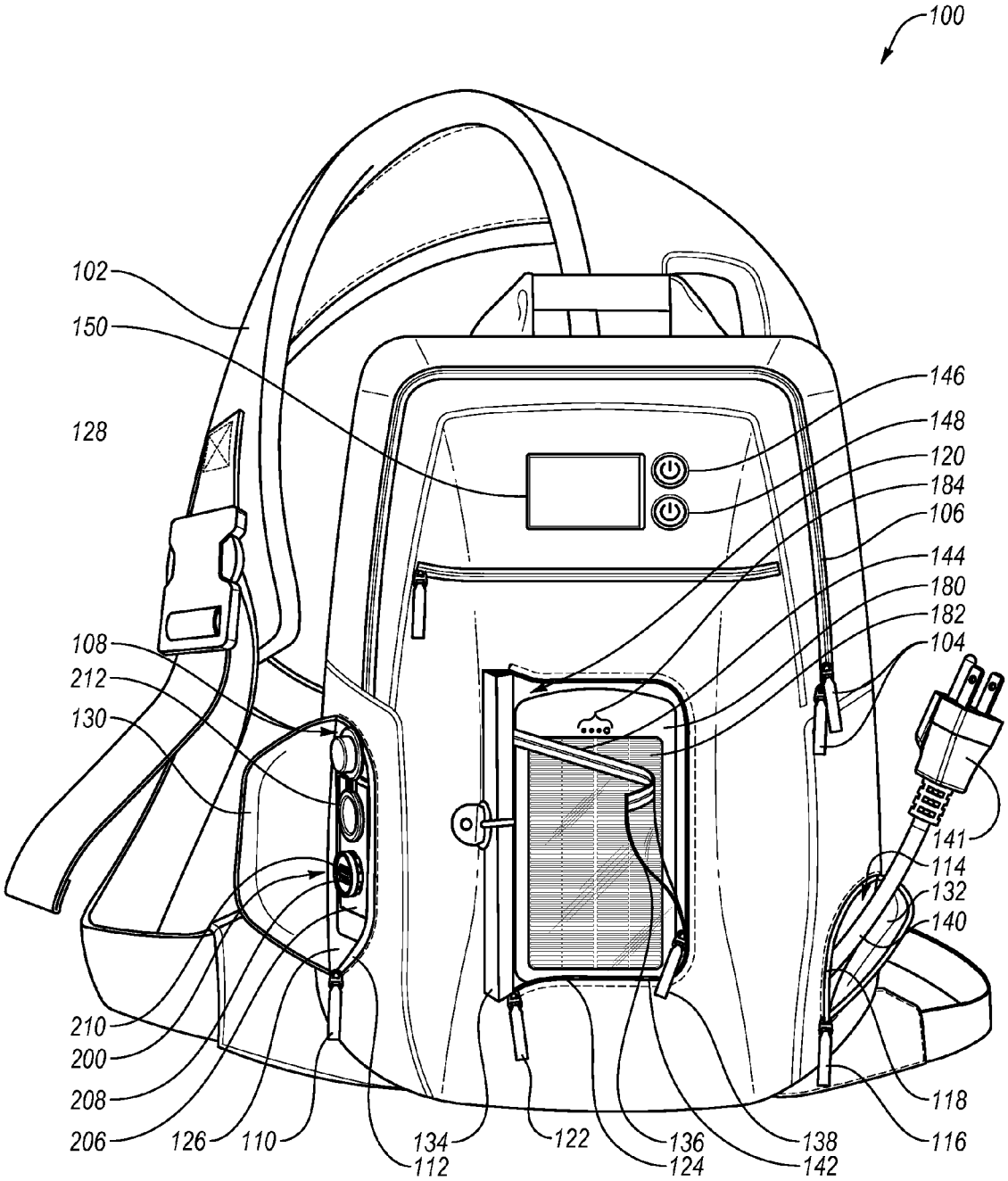
FIG. 1C is a front view of the example sling bag of FIG. 1B with the built-in rotatable receptacle device rotated to a second position.

FIGS. 1A-1C disclose an example sling bag 100. In particular, FIG. 1 is a front view of the example sling bag 100, FIG. 1B is a front view of the example sling bag 100 with a built-in rotatable receptacle device 200, a built-in power cord 140, and a battery 180 exposed, and FIG. 1C is a front view of the example sling bag 100 with the receptacle device 200 rotated to a second position.

As disclosed in FIGS. 1A-1C, the sling bag 100 may include a strap 102 for carrying or slinging the sling bag 100 over the shoulder of a user. In addition, the sling bag 100 may include various compartments for storing items, as well as compartments associated with providing power to electronic devices. In particular, the sling bag 100 may include an interior compartment (not shown) that may be accessed by pulling on pull tabs 104 of a zipper 106, an exterior receptacle compartment 108 that may be accessed by pulling on the pull tab 110 of the zipper 112, an exterior power cord compartment 114 that may be accessed by pulling on a pull tab 116 of a zipper 118, and an exterior battery compartment 120 that may be accessed by pulling on a pull tab 122 of a zipper 124. Each of these compartments will now be discussed in turn.

The interior compartment (not shown) may be defined within the sling bag 100 and may be at least partially defined by a compartment wall 126. The compartment wall 126 may separate the interior compartment from an exterior 128 of the sling bag 100.

The exterior receptacle compartment 108 may be positioned between the interior compartment (not shown) and the exterior 128 of the sling bag 100. The compartment wall 126 may also at least partially define the exterior receptacle compartment 108 and may separate the interior compartment (not shown) from the exterior receptacle compartment 108. A receptacle compartment cover 130 may also at least partially define the exterior receptacle compartment 108 and may be configured to be opened, by pulling on the pull tab 110 of the zipper 112, in order to expose at least a portion of the receptacle device 200 to the exterior 128 of the sling bag 100.

The exterior receptacle compartment 108 and the interior compartment (not shown) may each house a portion of the receptacle device 200. In particular, the receptacle device 200 may be built into the compartment wall 126, which substantially positions a portion of the receptacle device 200 in the exterior receptacle compartment 108 and substantially positions another portion of the receptacle device 200 in the interior compartment (not shown).

The exterior power cord compartment 114 may be positioned between the interior compartment (not shown) and the exterior 128 of the sling bag 100. A power cord compartment cover 132 may at least partially define the exterior power cord compartment 114 and may be configured to be opened, by pulling on the pull tab 116 of the zipper 118, in order to expose the power cord 140 to the exterior 128 of the sling bag 100. An electrical plug 141 that terminates the power cord 140 may be any standard or nonstandard electrical plug that is configured to be plugged into a power outlet. The power cord 140 may be in electrical communication with the receptacle device 200 so that when the electrical plug 141 is plugged into a power outlet, such as a power outlet in a public space such as an airport, a bus terminal, a rest stop, a museum, or a park (not shown), electrical power may be provided through the power cord 140 to the receptacle device 200, and to any electronic device that is plugged into one of the receptacles of the receptacle device 200. Since the receptacle device 200 includes four electrical receptacles, as discussed in greater detail below, the power cord 140 may be employed to provide electrical power from a single power outlet to four separate electronic devices. The power cord 140 may be at least partially automatically retractable into the exterior power cord compartment 114 of the sling bag 100 when the power cord 140 is no longer in use. For example, the power cord 140 may include a retracting mechanism (not shown) that enables the power cord 140 to be automatically retracted when the retracting mechanism is triggered. This retracting mechanism may be powered by a spring or by an electric motor, for example. Alternatively, the power cord 140 may be configured to be manually wound into the exterior power cord compartment 114 when the power cord 140 is no longer in use.

The exterior battery compartment 120 may be positioned between the interior compartment (not shown) and the exterior 128 of the sling bag 100. A battery compartment cover 134 may at least partially define the exterior battery compartment 120 and may be configured to be opened, by pulling on the pull tab 122 of the zipper 124, in order to expose the battery 180 to the exterior 128 of the sling bag 100. As disclosed in FIG. 1B, the battery 180 may be in electrical communication with the receptacle device 200 and may be configured to provide electrical power to the receptacle device 200, and to any electronic device that is plugged into one of the receptacles of the receptacle device 200, even when the electrical plug 141 that terminates the power cord 140 is not plugged into a power outlet and even while the user is walking along carrying the sling bag 100 over the user's shoulder. In some example embodiments, the battery 180 may be configured to provide electrical power to only a portion of the receptacles of the receptacle device 200. For example, the battery 180 may be configured to provide electrical power only to one or more USB receptacles, and not provide power to standard receptacles, since the USB receptacles may draw less power than the standard receptacles.

As disclosed in FIGS. 1B and 1C, the battery 180 may also be in electrical communication with the power cord 140 so that when the electrical plug 141 is plugged into a power outlet, electrical power may be provided through the power cord 140 to the battery 180 to recharge the battery 180. In some embodiments, a switch may be included (not shown) that would allow either manual or automatic switching between the power cord 140 providing power to recharge the battery 180 and providing power to power the receptacle device 200. This same or another switch may be configured to automatically switch from the receptacle device 200 drawing power from the battery 180 to the receptacle device 200 drawing power from the power cord 140 once the electrical plug 141 is plugged into a power outlet, to thus conserve the electrical power stored in the battery 180. In some embodiments, the power cord 140 may only provide power to recharge the battery 180 until the battery 180 is fully recharged, at which point power will automatically be cut off to the battery 180 to avoid over-charging, and thus damaging, the battery 180. Further, a surge protector may be included in the electrical path between the power cord 140 and the battery 180 and/or between the power cord 140 and the receptacle device 200 to avoid any surge in power from the power outlet from damaging the battery 180, the receptacle device 200, and/or any electronic devices that are plugged into the receptacles of the receptacle device 200.

As disclosed in FIGS. 1B and 1C, the battery 180 may also include a built-in solar panel 182 that may be configured to convert sunlight to electrical power and then provide the electrical power to the battery 180. To accommodate the built-in solar panel 182 of the battery 180, the exterior battery compartment 120 may further include a battery-retaining sleeve 136 that is configured to retain the battery 180 substantially within the exterior battery compartment 120 even while the battery compartment cover 134 is opened. The battery-retaining sleeve 136 may be at least partially translucent to allow light to pass through the battery-retaining sleeve 136 to the built-in solar panel 182 while the battery-retaining sleeve 136 is retaining the battery 180 substantially within the exterior battery compartment 120, thereby allowing the battery 180 to be recharged using sunlight without removing the battery 180 from the sling bag 100, even while the user is walking along carrying the sling bag 100 over the user's shoulder. The battery-retaining sleeve 136 may be opened by pulling on a pull tab 138 of a zipper 142, thereby allowing the battery 180 to be removed from the exterior battery compartment 120. Alternatively, the battery 180 may be slipped out of the top of the exterior battery compartment 120 by slipping the battery 180 past a top edge 144 of the battery-retaining sleeve 136.

As disclosed in FIGS. 1B and 1C, the battery 180 may include a recharge indicator 184, either on the battery 180 itself, or somewhere else on the sling bag 100, such as on an electronic display 150, as discussed below, or on or near the receptacle device 200 (see the recharge indicator 616 of FIG. 6 and the recharge indicator 718 of FIG. 7). The recharge indicator 184 may be configured to indicate the recharge status of the battery 180. For example, and as illustrated in FIGS. 1B and 1C, the recharge indicator 184 may include four LED indicator lights, the leftmost three of which may be green, and the rightmost of which may be red. Where the battery 180 is 75%-100% charged, the three green LED indicator lights may be lit. Where the battery 180 is 50%-75% charged, only the middle two green LED indicator lights may be lit. Similarly, where the battery 180 is 25%-50% charged, only the rightmost green LED indicator light may be lit. Finally, where the battery 180 is under 25% charged, only the rightmost red LED indicator light may be lit. In this manner, the user may quickly ascertain how much charge remains in the battery 180 that is available for charging any electronic devices plugged into the receptacles of the receptacle device 200 when the power cord 140 is not plugged into a power outlet.

As disclosed in FIGS. 1A-1C, the sling bag 100 may also include a first built-in power button 146, a second built-in power button 148, and a built-in electronic display 150, positioned as illustrated in FIGS. 1A-1C, or positioned somewhere else on the sling bag 100, such as on or near the receptacle device 200. The first power button 146 may be configured, when pressed, to supply power, in the form of alternating current (AC), through the power cord 140 to the receptacle device 200. Similarly, the second power button 148 may be configured, when pressed, to supply power, in the form of direct current (DC), from the battery 180 to the receptacle device 200. The electronic display 150 may be a touch screen LCD display or other electronic display and may be configured, when activated by a tap or swipe of the user's finger for example, to display a variety of information to the user including, but not limited to, a recharge level of the battery 180, a solar-recharging status of the battery 180, an operational time remaining based on current power usage of the battery 180, a current draw of power by electronic devices plugged into the receptacle device 200, an on/off status of the first built-in power button 146, an on/off status of the second built-in power button 148, a plugged in/not plugged in status of the power cord 140, or some combination thereof. It is noted that due to the limited display area of the electronic display 150, the information displayed by the electronic display 150 may appear in two or more screens that the user may cycle through while interacting with the electronic display 150.

As disclosed in FIG. 1B, the receptacle device 200 may include a first side 202 with a universal receptacle 204. As disclosed in FIG. 1C, the receptacle device 200 may also include a second side 206, positioned opposite the first side 202, with two USB receptacles 208 and 210 and a cigarette lighter receptacle 212. In some example embodiments, the USB receptacle 208 may be a 5V, 2.1 A USB receptacle, while the USB receptacle 210 may be a 5V, 1 A USB receptacle.

As noted previously, the receptacle device 200 may be rotatable between two or more positions with respect to the compartment wall 126. In particular, the receptacle device 200 may be configured to be rotated, with respect to the compartment wall 126, between the first side 202 and the second side 206 being exposed on the exterior 128 of the sling bag 100, at least where the receptacle compartment cover 130 is open or not present. In a similar manner, the receptacle device 200 may be configured to be rotated, with respect to the compartment wall 126, between the first side 202 and the second side 206 being exposed to the interior compartment (not shown) of the sling bag 100. In greater detail, the receptacle device 200 may be configured to be rotated to a first position, as disclosed in FIG. 1B, in which the first side 202 is exposed to the exterior 128 of the sling bag 100 while the second side 206 is exposed to the interior compartment (now shown), and then later rotated to a second position, as disclosed in FIG. 1C, in which the second side 206 is exposed to the exterior 128 of the sling bag 100 while the first side 202 is exposed to the interior compartment (now shown). In this manner, multiple electronic devices (not shown) may simultaneously be plugged into the electrical receptacles 204, 208, 210, and 212 in order to recharge or otherwise provide power to the electronic devices. Further, the rotatable aspect of the receptacle device 200 may enable any of the electrical receptacles 204, 208, 210, or 212 to recharge or otherwise provide power to an electronic device (not shown) with the electronic device positioned in the exterior 128 of the sling bag 100 or positioned in the interior compartment (not shown) of the sling bag 100.

Figure 2B:
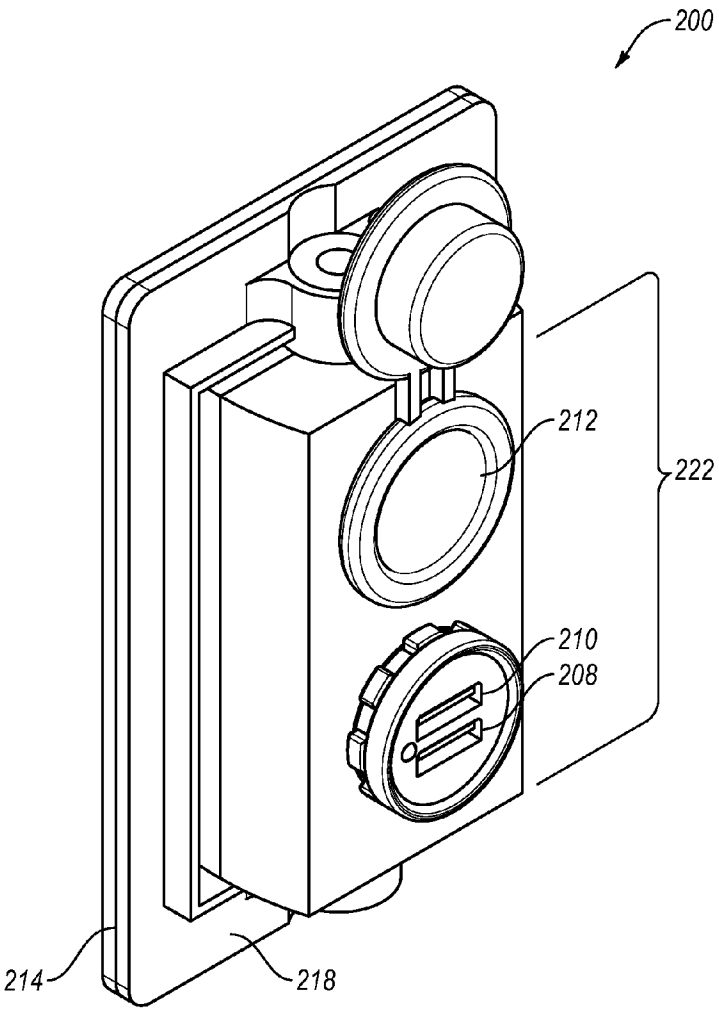
FIG. 2B is a rear perspective view of the receptacle device of FIGS. 1B and 1C.
Figure 2A:
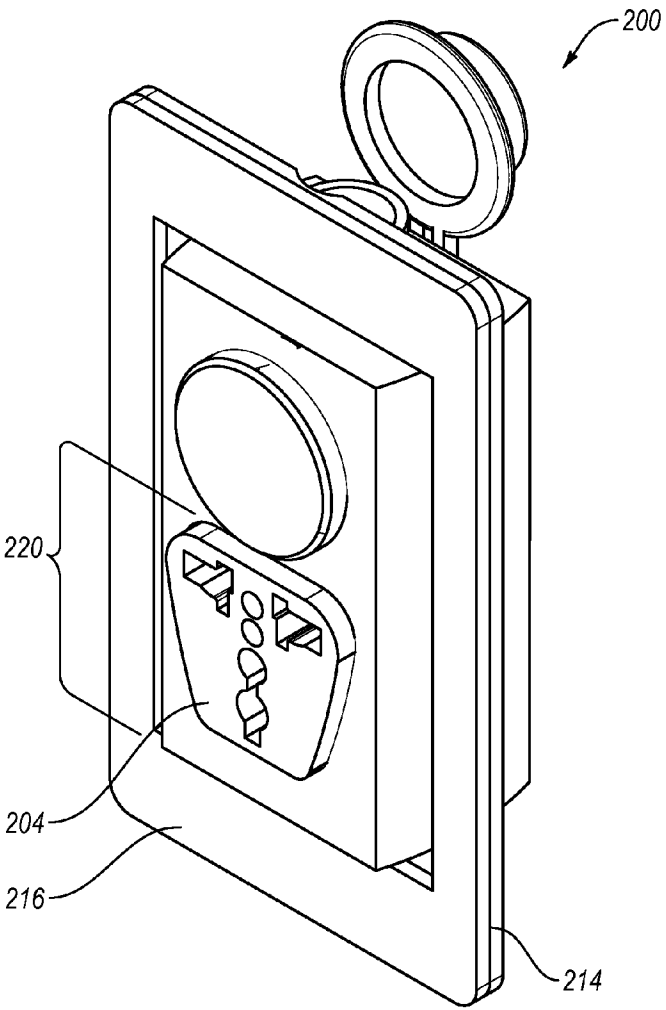
FIG. 2A is a front perspective view of the receptacle device of FIGS. 1B and 1C.

FIG. 2A is a front perspective view of the receptacle device 200 and FIG. 2B is a rear perspective view of the receptacle device 200. As disclosed in FIGS. 2A and 2B, the receptacle device 200 includes a frame 214 that is configured to be built into a bag, such as the sling bag 100 of FIGS. 1A-1C. In particular, the frame 214 may be configured to be configured to be built into a compartment wall of a bag that at least partially defines an interior compartment and that separates the interior compartment from an exterior of the bag, such as the compartment wall 126 disclosed in FIGS. 1B and 1C. In some example embodiments, the frame 214 may be configured in two pieces so that the frame 214 may be built into a compartment wall by a portion of the compartment wall being sandwiched in between the two pieces of the frame 214. The frame 214 may define an exterior side 216 that may be configured to be positioned on an exterior surface of a compartment wall of a bag, and may define an interior side 218 that may be configured to be positioned on an interior surface of a compartment wall of a bag.

A first set 220 of electrical receptacles, which includes the universal receptacle 204, may be rotatably attached to the frame 214 and may be configured to be rotated with respect to the frame 214 between being exposed on the exterior side 216 and being exposed on the interior side 218. Similarly, a second set 222 of electrical receptacles, which includes the two USB receptacles 208 and 210 and the cigarette lighter receptacle 212, may be rotatably attached to the frame 214 and may be configured to be rotated with respect to the frame 214 between being exposed on the exterior side 216 and being exposed on the interior side 218. The term "set of electrical receptacles" as used herein refers to a set that includes one or more electrical receptacles. As noted previously, the first and second sets 220 and 222 of receptacles may be configured to be in electrical communication with a power cord and/or a battery in order to provide electrical power to the first and second sets 220 and 222 of electrical receptacles, such as the power cord 140 and/or the battery 180 of FIGS. 1B and 1C.

Figure 3A:
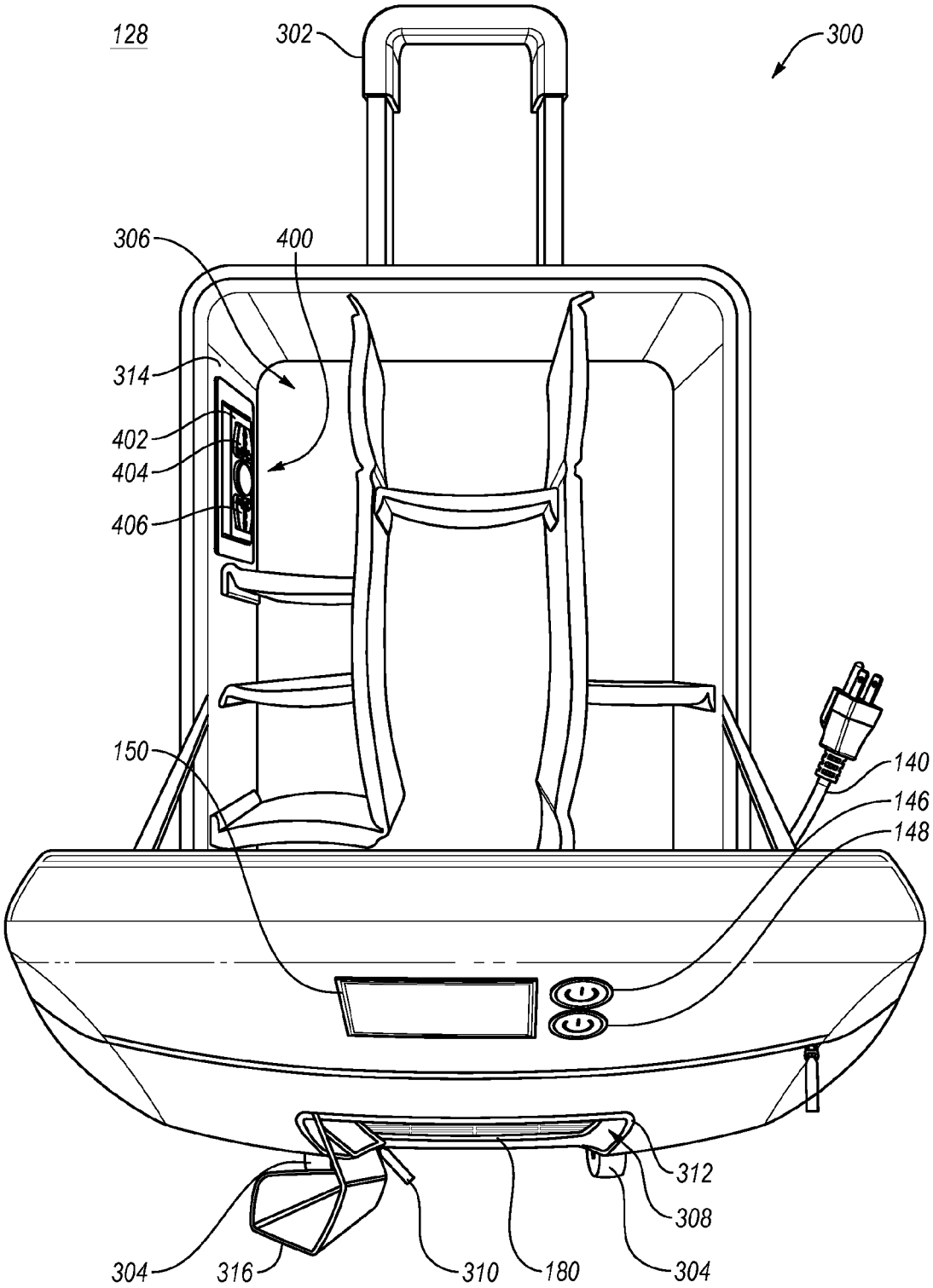
FIG. 3A is a front open view of an example camera roller bag with a built-in rotatable receptacle device, a built-in power cord, and a battery exposed.
Figure 3B:
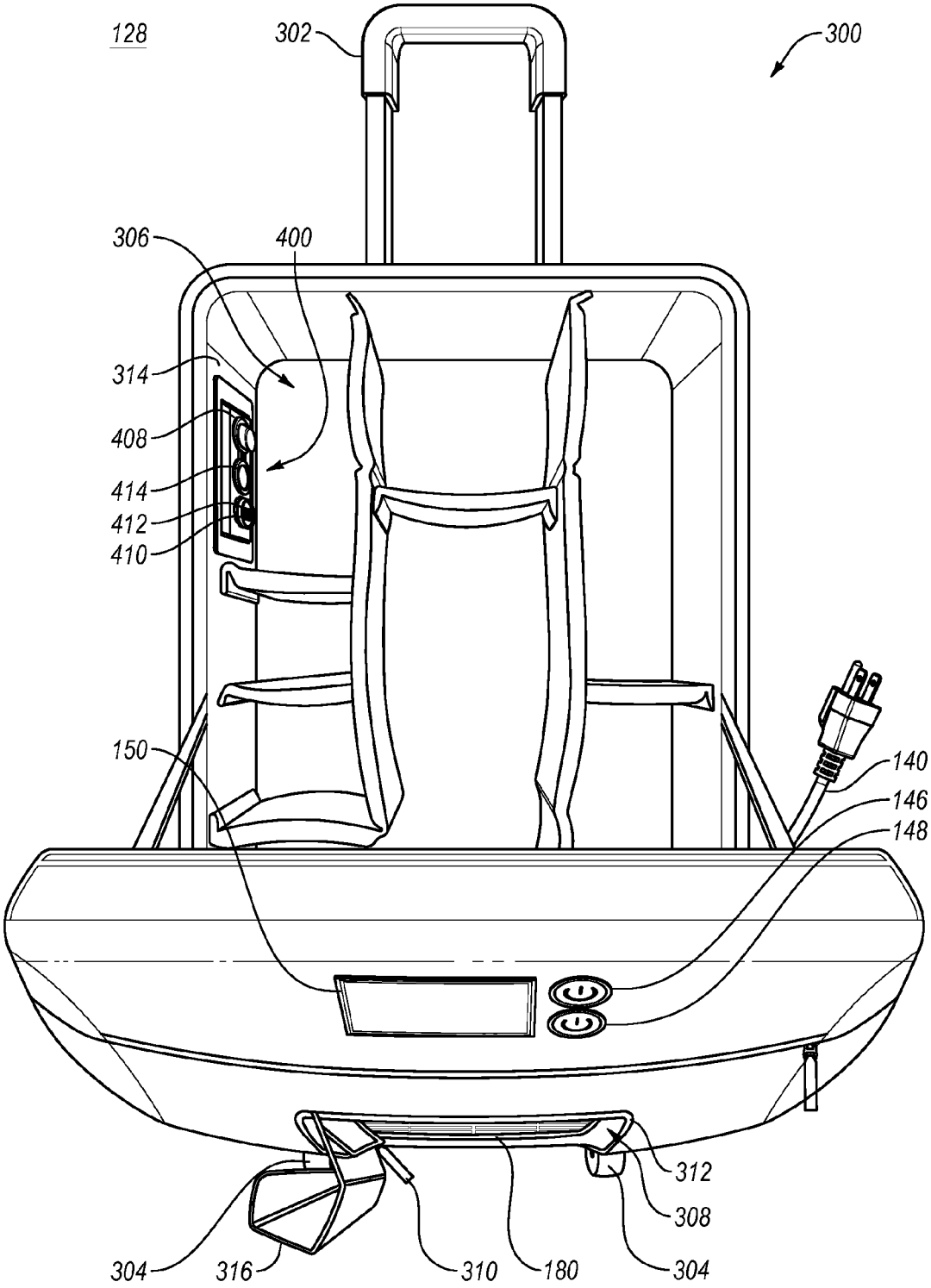
FIG. 3B is a front open view of the example camera roller bag of FIG. 2A with the built-in rotatable receptacle device rotated to a second position.

FIGS. 3A-3C disclose an example camera roller bag 300. In particular, FIG. 3A is a front open view of the example camera roller bag 300 with a built-in rotatable receptacle device 400, the built-in power cord 140, and the battery 180 exposed, and FIG. 3B is a front open view of the example camera roller bag 300 with the receptacle device 400 rotated to a second position.

As disclosed in FIG. 3A, the camera roller bag 300 may include a handle 302 and wheels 304 for rolling the camera roller bag 300 along a floor or walkway of a building such as an office building, an airport, or a sidewalk. In addition, the camera roller bag 300 may include various compartments for storing items as well as compartments associated with providing power to electronic devices. In particular, as disclosed in FIGS. 3A and 3B, the camera roller bag 300 may include an interior compartment 306 that may be accessed by pulling on the pull tabs of a zipper (now shown), and an exterior battery compartment 308 that can be accessed by pulling on a pull tab 310 of a zipper 312. Each of these compartments will be discussed in turn.

The interior compartment 306 may be defined within the camera roller bag 300 and may be at least partially defined by a compartment wall 314. The compartment wall 314 separates the interior compartment from the exterior 128 of the camera roller bag 300. The interior compartment 306 may house a portion of the receptacle device 400. In particular, since the receptacle device 400 is built into the compartment wall 314, a portion of the receptacle device 400 may be substantially positioned within the interior compartment 306. At the same time, another portion of the receptacle device 400 may be substantially positioned in the exterior 128 of the camera roller bag 300.

The exterior battery compartment 308 may be positioned between the interior compartment (not shown) and the exterior 128 of the camera roller bag 300 and may include a battery compartment cover 316. The exterior battery compartment 308, the battery compartment cover 316, the pull tab 310, and the zipper 312 of the camera roller bag 300 of FIGS. 3A and 3B may be similar in structure and function to the exterior battery compartment 120, the battery compartment cover 134, the pull tab 122, and the zipper 124 of the sling bag 100 of FIGS. 1A-1C. In addition, both the exterior battery compartment 120 of the sling bag 100 of FIGS. 1A-1C and the exterior battery compartment 308 of the camera roller bag 300 of FIGS. 3A and 3B are configured to store the battery 180. It is understood that in some embodiments, however, the battery included in the camera roller bag 300 of FIGS. 3A and 3B may be larger and have greater power storage capacity than the battery included in the sling bag 100 of FIGS. 1A-1C, or vice versa.

The camera roller bag 300 of FIGS. 3A and 3B may also include the first built-in power button 146, the second built-in power button 148, and the built-in electronic display 150, which function in a similar manner with respect to the receptacle device 400 as they do with respect to the receptacle device 200 as described in FIGS. 1A-1C.

The receptacle device 400 may include a first side 402, as disclosed in FIG. 3A, with a first universal receptacle 404 and a second universal receptacle 406. The receptacle device 400 may also include a second side 408, positioned opposite the first side 402, with two USB receptacles 410 and 412 and a cigarette lighter receptacle 414.

As noted previously, the receptacle device 400 may be rotatable between two or more positions with respect to the compartment wall 314. In particular, the receptacle device 400 may be configured to be rotated, with respect to the compartment wall 314, between the first side 402 and the second side 408 being exposed to the exterior 128 of the camera roller bag 300. In a similar manner, the receptacle device 400 may be configured to be rotated, with respect to the compartment wall 314, between the first side 402 and the second side 408 being exposed to the interior compartment 306 of the camera roller bag 300. In greater detail, the receptacle device 400 may be configured to be rotated to a first position, as disclosed in FIG. 3A, in which the second side 408 is exposed to the exterior 128 of the camera roller bag 300 while the first side 402 is exposed to the interior compartment 306, and then later rotated to a second position, as disclosed in FIG. 3B, in which the first side 402 is exposed to the exterior 128 of the camera roller bag 300 while the second side 408 is exposed to the interior compartment 306. In this manner, multiple electronic devices (not shown) may simultaneously be plugged into the electrical receptacles 404, 406, 410, 412, and 414 in order to recharge or otherwise provide power to the electronic devices. Further, the rotatable aspect of the receptacle device 400 may enable any of the electrical receptacles 404, 406, 410, 412, or 414 to recharge or otherwise provide power to an electronic device (not shown) with the portable electronic device positioned in the exterior 128 of the camera roller bag 300 or positioned in the interior compartment 306 of the camera roller bag 300.

Figure 4B:
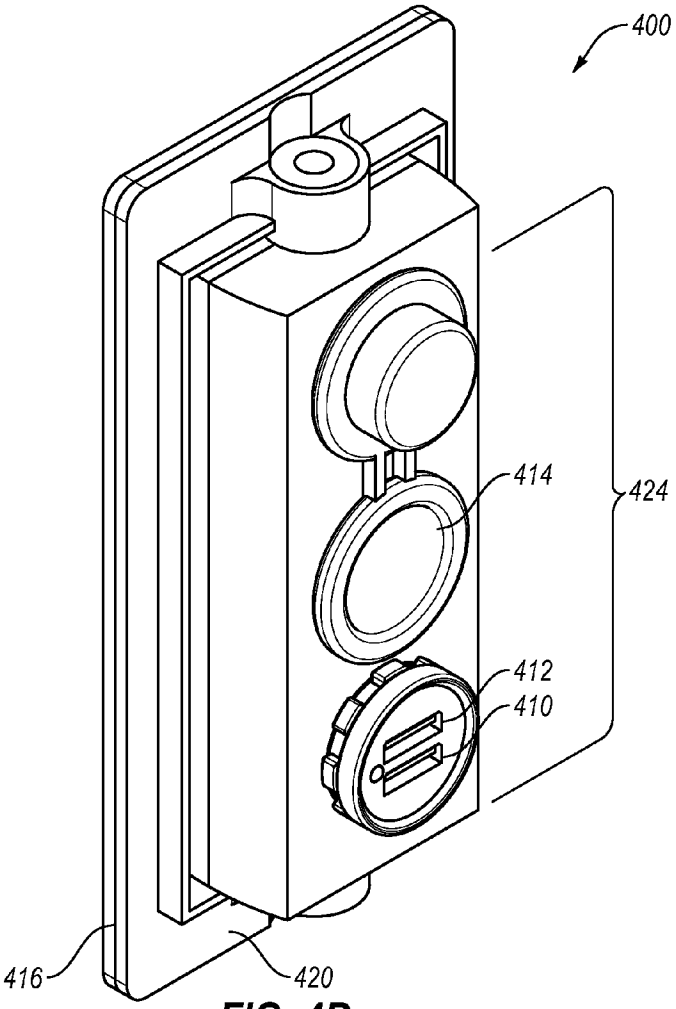
FIG. 4B is a rear perspective view of the receptacle device of FIGS. 3A and 3B.
Figure 4A:
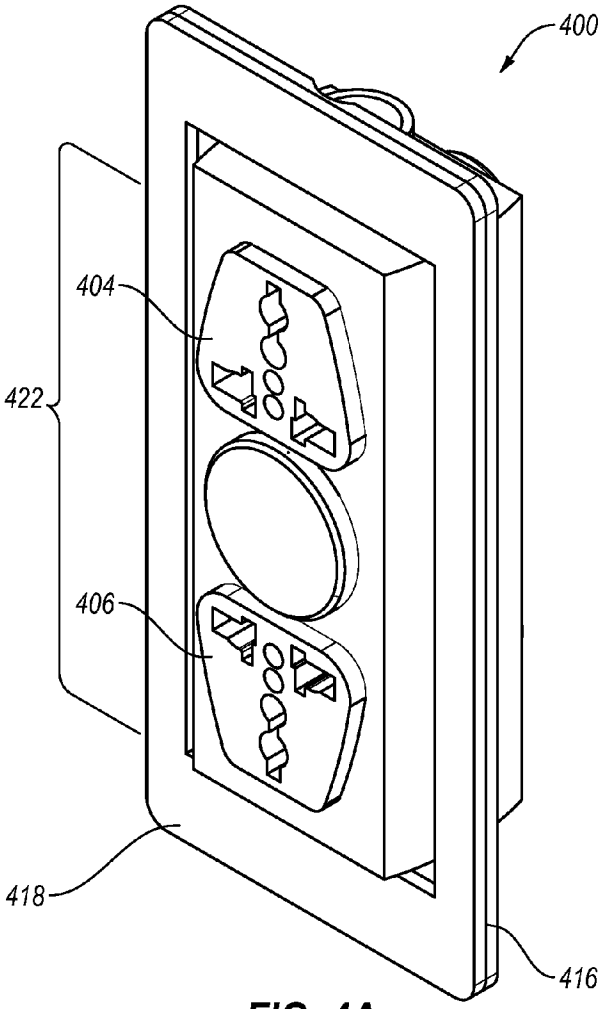
FIG. 4A is a front perspective view of the receptacle device of FIGS. 3A and 3B.

FIG. 4A is a front perspective view of the receptacle device 400 and FIG. 4B is a rear perspective view of the receptacle device 400. As disclosed in FIGS. 4A and 4B, the receptacle device 400 includes a frame 416 that is configured to be built into a bag, such as the camera roller bag 300 of FIGS. 3A and 3B. In particular, the frame 416 may be configured to be built into a compartment wall of a bag that at least partially defines an interior compartment and that separates the interior compartment from an exterior of the bag, such as the compartment wall 314 disclosed in FIGS. 3A and 3B. The frame 416 may define an exterior side 418 that may be configured to be positioned on an exterior surface of a compartment wall of a bag, and may define an interior side 420 that may be configured to be positioned on an interior surface of a compartment wall of a bag.

A first set 422 of electrical receptacles, which includes the first and second universal receptacles 404 and 406, may be rotatably attached to the frame 416 and may be configured to be rotated with respect to the frame 416 between being exposed on the exterior side 418 and being exposed on the interior side 420. Similarly, a second set 424 of electrical receptacles, which includes the two USB receptacles 410 and 412 and the cigarette lighter receptacle 414, may be rotatably attached to the frame 416 and may be configured to be rotated with respect to the frame 416 between being exposed on the exterior side 418 and being exposed on the interior side 420. As noted previously, the first and second sets 422 and 424 of receptacles may be configured to be in electrical communication with a power cord and/or battery in order to provide electrical power to the first and second sets 422 and 424 of electrical receptacles, such as the power cord 140 and/or the battery 180 of FIGS. 3A and 3B.

Figure 6:
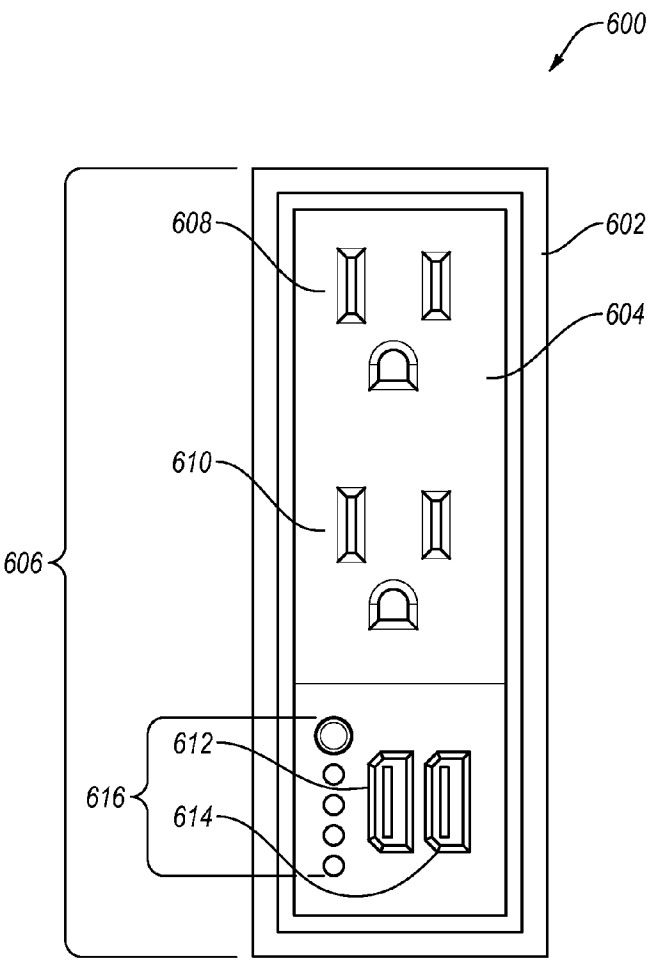
FIG. 6 is a front view of another example receptacle device.
Figure 5:
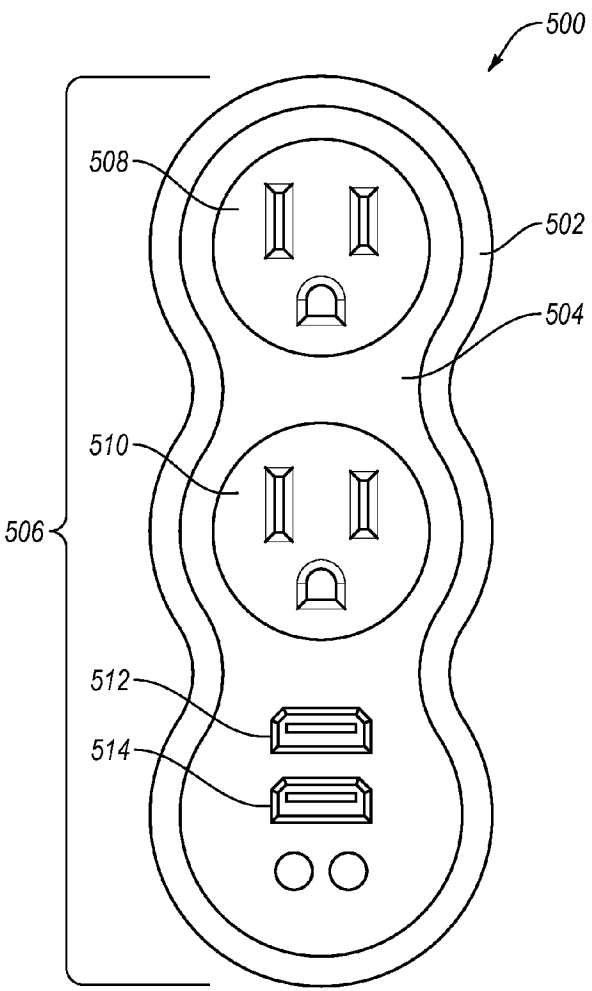
FIG. 5 is a front view of another example receptacle device.
Figure 7:
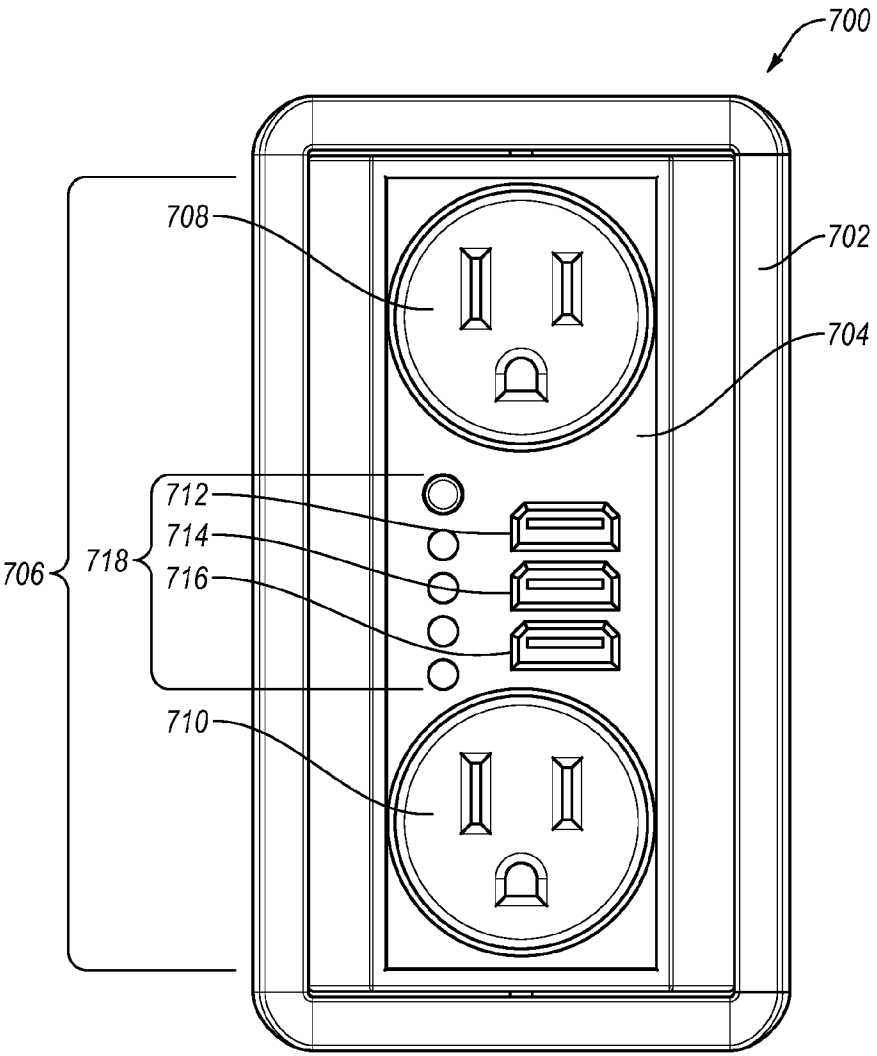
FIG. 7 is a front view of another example receptacle device.

FIGS. 5, 6, and 7 are front views of other example receptacle devices 500, 600, and 700, respectively. As disclosed in FIGS. 5, 6, and 7, the receptacle devices 500, 600, and 700 include frames 502, 602, and 702, respectively, which are configured to be built into a bag, such as the sling bag 100 of FIGS. 1A-1C or the camera roller bag 300 of FIGS. 3A and 3B. In particular, the frame 502, 602, or 702 may be configured to be built into a compartment wall of a bag that at least partially defines an interior compartment and that separates the interior compartment from an exterior of the bag, such as the compartment wall 126 disclosed in FIGS. 1B and 1C or the compartment wall 314 disclosed in FIGS. 3A and 3B. The frames 502, 602, and 702 may define sides 504, 604, and 704, respectively, which may be configured to be exposed to the exterior of a bag or exposed to an interior compartment of the bag. Further, any of the receptacle devices 500, 600, or 700 may be configured to be rotated between the side 504, 604, or 704 being exposed to an exterior of a bag and the side 504, 604, or 704 being exposed to an interior compartment of the bag.

The receptacle devices 500, 600, and 700 may further include sets 506, 606, and 706 of electrical receptacles, respectively. The set 506 of electrical receptacles may include two standard receptacles 508 and 510 and two USB receptacles 512 and 514. The set 606 of electrical receptacles may include two standard receptacles 608 and 610 and two USB receptacles 612 and 614, as well as the recharge indicator 616, which may function similarly as the recharge indicator 184 disclosed in FIGS. 1B and 1C. The set 706 of electrical receptacles includes two standard receptacles 708 and 710 and three USB receptacles 712, 714, and 716, as well as the recharge indicator 718, which may function similarly as the recharge indicator 184 disclosed in FIGS. 1B and 1C. The sets 506, 606, and 706 of electrical receptacles may each be configured to be in electrical communication with a power cord and/or a battery, such as the power cord 140 and the battery 180 of FIGS. 1B, 1C, 3A, and 3B, in order to provide electrical power to each of the sets 506, 606, and 706 of electrical receptacles.

It is understood that the receptacle configurations of the receptacle devices disclosed herein, including the number and types of receptacles included in each receptacle device, are only a few examples of countless possible receptacle configurations. For example, although the standard receptacles disclosed herein may be the North American NEMA 5-15 connectors, the universal receptacles disclosed herein may be designed to accept British plugs in addition to Euro, NEMA American and Australian plugs, and the USB receptacles disclosed herein may be standard USB 2.0 dedicated charging ports, it is understood that any other standard or nonstandard electrical receptacles may be employed. For example, electrical receptacles according to any of the following standards may be employed: NEMA 1-15 unpolarised; NEMA 1-15 polarised; JIS C 8303, Class II; NEMA 5-15; NEMA 5-20; JIS C 8303, Class I; CEE 7/16 (Europlug); CEE 7/17; GOST 7396 C 1; BS 4573; BS 546; CEE 7/5; CEE 7/4 Schuko; BS 1363; IS 401 & 411; MS 589; SS 145; S132; TIS 166-2549; AS/NZS 3112; CPCS-CCC; IRAM 2073; Swiss SEV 1011:2009/A1:2012 Typ 12 & Typ 13; Danish 107-2-D1; CEI 23-16/VII; South Africa SABS 164-1; Brazilian NBR 14136 (2 pin); Brazilian NBR 14136 (3 pin); South Africa SABS 164-2 (2 pin); South Africa SABS 164-2 (3 pin); or some combination thereof. Also, a barrel plug may be employed. Further, any of the receptacles disclosed herein may additionally or alternatively be modular such that they may easily be switched out with other receptacles, depending on the standard receptacles in use in different parts of the world. The electrical plug 141 that terminates the power cord 140 may also additionally or alternatively be similarly modular to allow for the electrical plug 141 to be easily switched out to allow the electrical plug 141 to be made compatible with standard power outlets in use in different parts of the world. Further, each of the "electrical receptacles" included in the receptacle devices disclosed herein may additionally or alternatively be replaced with a corresponding "electrical plug" or cord that terminates in a corresponding "electrical receptacle" or "electrical plug" to allow electronic devices to be directly attached to this replacement to avoid the user having to carry electrical cords corresponding to each of the user's electronic devices. In other words, the "electrical plug" and/or corresponding "electrical cords" may be built into the receptacle devices disclosed herein.

It is understood that the power cord 140 and/or the battery 180 may provide electrical power to the vicinity of the sling bag 100 or the camera roller bag 300 such that other electricity-powered devices may be included with or even built into the sling bag 100 or the camera roller bag 300. For example, the power cord 140 and/or the battery 180 may provide electrical power to any of the following electricity-powered devices that is built into the sling bag 100 and/or the camera roller bag 300: a light, a digital video camera, an audio recording device, a theft prevention alarm, a motion detector (configured to trigger the built-in light, the digital video camera, the audio recording device, and/or the theft prevention alarm, for example), a radio transceiver and/or cellular phone transceiver, one or more speakers, a back or hand heater, an AM/FM and/or satellite radio and/or digital music player, an electric hot plate for cooking food, a locating beacon and/or GPS receiver, a clock and/or stop watch, a digital thermometer, a remote control signal sensor, or some combination thereof. Each of these built-in electricity-powered devices may be built into the sling bag 100 or the camera roller bag 300 by being sewn into a compartment dedicated to the electricity-powered device, or otherwise attached to a compartment wall or other structural feature of the sling bag 100 or the camera roller bag 300.

All examples and conditional language recited herein are intended for pedagogical objects to aid the reader in understanding the example embodiments and the concepts contributed by the inventor to furthering the art, and are to be construed as being without limitation to such specifically-recited examples and conditions.

The invention claimed is:

1. A receptacle device comprising:

a frame configured to be built into a bag and defining an interior side and an exterior side; and a first set of electrical receptacles rotatably attached to the frame, the first set of electrical receptacles being configured to be rotated with respect to the frame between being exposed on the exterior side and being exposed on the interior side.

2. The receptacle device as recited in claim 1, wherein the frame is configured to be built into a compartment wall of a bag that at least partially defines an interior compartment and that separates the interior compartment from an exterior of the bag.

3. The receptacle device as recited in claim 1, wherein the first set of electrical receptacles is configured to be in electrical communication with a power cord that is configured to plug into a power outlet in order to provide electrical power to the first set of electrical receptacles.

4. The receptacle device as recited in claim 1, wherein the first set of electrical receptacles is configured to be in electrical communication with a battery that is configured to provide electrical power to the first set of electrical receptacles.

5. The receptacle device as recited in claim 1, further comprising:

a second set of electrical receptacles rotatably attached to the frame, the second set of electrical receptacles being positioned opposite the first set of electrical receptacles, the second set of electrical receptacles being configured to be rotated with respect to the frame between:

being exposed on the exterior side while the first set of electrical receptacles is exposed on the interior side; and being exposed on the interior side while the first set of electrical receptacles is exposed on the exterior side.

6. The bag as recited in claim 5, wherein:

the first set of electrical receptacles includes a cigarette lighter receptacle and two USB receptacles; and the second set of electrical receptacles includes a standard receptacle and two USB receptacles.

7. A bag comprising:

an interior compartment;

a compartment wall at least partially defining the interior compartment and separating the interior compartment from an exterior of the bag; and a first set of electrical receptacles built into the compartment wall, the first set of electrical receptacles being configured to be rotatable in the compartment wall between being exposed to the exterior of the bag and being exposed to the interior compartment.

8. The bag as recited in claim 7, further comprising:

a power cord in electrical communication with the first set of electrical receptacles and configured to plug into a power outlet in order to provide electrical power to the first set of electrical receptacles.

9. The bag as recited in claim 8, wherein the power cord is at least partially automatically retractable into the bag.

10. The bag as recited in claim 8, further comprising:

a power button that is built into the bag and that is configured, when pressed, to supply power through the power cord to the first set of electrical receptacles.

11. The bag as recited in claim 7, further comprising:

a battery in electrical communication with the first set of electrical receptacles and configured to provide electrical power to the first set of electrical receptacles.

12. The bag as recited in claim 11, further comprising:

a power button that is built into the bag and that is configured, when pressed, to supply power from the battery to the first set of electrical receptacles.

13. The bag as recited in claim 7, further comprising:

a second set of electrical receptacles built into the compartment wall, the second set of electrical receptacles being positioned opposite the first set of electrical receptacles, the second set of electrical receptacles being configured to be rotatable in the compartment wall between:

being exposed to the exterior of the bag while the first set of electrical receptacles is exposed to the interior compartment; and being exposed to the interior compartment while the first set of electrical receptacles is exposed to the exterior of the bag.

14. The bag as recited in claim 13, wherein:

the first set of electrical receptacles includes a cigarette lighter receptacle and two USB receptacles; and the second set of electrical receptacles includes a standard receptacle and two USB receptacles.

15. A bag comprising:

an interior compartment;

a compartment wall at least partially defining the interior compartment and separating the interior compartment from an exterior of the bag;

a frame built into the compartment wall; and a receptacle device including:

a first side with a first electrical receptacle;

a second side, positioned opposite the first side, with a second electrical receptacle; and a central axis along which the receptacle device is rotatably attached to the frame and around which the receptacle device is configured to rotate between:

a first position of the receptacle device in which the first side is exposed to the exterior of the bag while the second side is exposed to the interior compartment; and a second position of the receptacle device in which the second side is exposed to the exterior of the bag while the first side is exposed to the interior compartment.

16. The bag as recited in claim 15, wherein:

the receptacle device is configured to rotate 180 degrees around the central axis to rotate between the first position of the receptacle device and the second position of the receptacle device.

17. The bag as recited in claim 15, wherein:

the receptacle device is configured to rotate 360 degrees around the central axis to rotate between the first position of the receptacle device and the second position of the receptacle device.

18. The bag as recited in claim 15, further comprising:

a power cord in electrical communication with the receptacle device and configured to plug into a power outlet in order to provide electrical power to the receptacle device; and a power button that is built into the bag and that is configured, when pressed, to supply power through the power cord to the receptacle device.

19. The bag as recited in claim 15, further comprising:

a battery in electrical communication with the receptacle device and configured to provide electrical power to the receptacle device; and a power button that is built into the bag and that is configured, when pressed, to supply power from the battery to the receptacle device.

20. The bag as recited in claim 15, wherein:

the first electrical receptacle is a cigarette lighter receptacle;

the first side further includes a first set of two USB receptacles;

the second electrical receptacle is a standard receptacle; and the second side further includes a second set of two USB receptacles.

* * * * *